US005334996A

United States Patent [19]

Tanigaki et al.

[11] Patent Number: 5,334,996

[45] Date of Patent: Aug. 2, 1994

[54] COLOR DISPLAY APPARATUS

[75] Inventors: Yasushi Tanigaki; Yoshikazu Satoh; Yoshiharu Kobayashi, all of Tokyo, Japan

[73] Assignee: U.S. Philips Corporation, New York, N.Y.

[21] Appl. No.: 603,974

[22] Filed: Oct. 23, 1990

[30] Foreign Application Priority Data

Dec. 28, 1989 [JP] Japan ..... 1-342096

[51] Int. Cl.[5] ..... G09G 1/28

[52] U.S. Cl. ..... 345/152; 345/136; 345/192

[58] Field of Search ..... 340/701, 703, 730, 728, 340/735, 750, 748; 345/150, 152, 141, 143, 136, 186, 192

[56] References Cited

U.S. PATENT DOCUMENTS 4,217,577 8/1980 Roe et al. ..... 340/703
4,544,922 10/1985 Watanabe et al. ..... 340/728
4,595,917 6/1985 McCallister et al. ..... 340/703
4,642,628 2/1987 Murata ..... 340/703
4,763,120 8/1988 Morrish et al. ..... 340/703
4,837,562 6/1989 Nishiura et al. ..... 340/728
4,896,146 1/1990 Narumiya ..... 340/701
4,986,637 1/1991 Yamaguchi ..... 340/702
5,043,917 8/1991 Okamoto ..... 340/703

FOREIGN PATENT DOCUMENTS 2221077 1/1990 United Kingdom .

*Primary Examiner*—Ulysses Weldon
*Assistant Examiner*—Regina Liang
*Attorney, Agent, or Firm*—Robert J. Kraus

[57] ABSTRACT

A color display apparatus which stores the color information of characters to be displayed in three storage planes (4R, 4C, 4B) of a character generator so that this information can be used in a display controller (21) in such a way that high-quality characters are displayed on a display panel. The information is stored so that different sequences of 3-bit color dots can be displayed.

20 Claims, 3 Drawing Sheets

COLOR DISPLAY APPARATUS

BACKGROUND OF THE INVENTION

This invention relates to a color display apparatus with a display panel, for example, of the liquid crystal type, and more particularly to a color display apparatus which is capable of displaying patterns, such as characters, of a good quality and with a limited number of pixels.

A color display panel constructed, for example, with a liquid crystal material has color dots of the three primary colors (R, G and B) formed thereon in a predetermined order, wherein a color pixel is usually constituted by three adjacent ones of the color dots respectively corresponding to the three primary colors. In this case, the assignment of the combinations of color dots of the three primary colors on the display panel to the respective color pixels on the same panel is fixed in accordance with a rule determined in dependence on the kind of panel. With this kind of color display panel, a pattern such as a character is displayed in a display unit which is a matrix of a predetermined number of pixels.

In recent years, there has been an increase in the number of color display panels of the active-panel type in which a TFT is used for each display dot. In a color display panel of the above type, the upper limit of the resolution is of the order of 720×240 color dots (i.e., of the order of 240×240 pixels since a pixel is formed by three color dots). This is because it is difficult to form a greater number of TFTs on a broad surface of a panel without suffering a decrease in the yield rate of the panels. However, with a color display panel having a resolution of the above order it is still possible to display a PAL or an NTSC television picture of a sufficiently good quality and to display information such as characters of a good quality provided that the characters are large in size.

In recent years there has been a demand for a liquid crystal display panel of the above type which can be used not only to display a television picture, but also to display character information, for example, via a character broadcasting or a teletext. In the case of the European teletext, it is necessary to display about forty characters in the horizontal direction. Since the number of pixels in the horizontal direction is about 240, even in the recent liquid crystal color display panels as described earlier, the number of pixels for each character in the horizontal direction must be restricted to about five in order to display all the characters, that is to say, the number of color dots in the horizontal direction must be restricted to about fifteen.

FIG. 5 is an illustration showing an enlarged portion of a display panel of the conventional liquid crystal color display apparatus, the portion shown corresponding to one character. In the display panel, shown, a number of color dots (720 color dots in this example) of the three primary colors are arranged in the order of a red (R) color dot 2*r*, a green (G) color dot 2*g* and a blue (B) color dot 2*b* in a cyclic fashion in the horizontal direction, and a number of color dots (240 color dots in this example) of the same color are formed in the vertical direction, whereby a dot matrix is formed in which the color dots of the three primary colors are distributed entirely and uniformly on the panel. In each horizontal line, each color pixel 3 is formed by a respective one of the combinations of three adjacent color dots, namely, a red (R) color dot 2*r*, a green (G) color dot 2*g* and a blue (B) color dot 2*b* which are arranged in this order from left to right, whereby a color pixel matrix, for example, of 240×240 is formed on the panel as a whole. With this conventional display apparatus, one character (for example, the character A in FIG. 5) is displayed in a 5×9 color pixel matrix. In this case, the display apparatus has a memory 4 in which the respective character patterns are stored in the form of 5×9 bit patterns as shown in FIG. 6 (only the bit pattern for the character "A" is shown in FIG. 6). Those color dots 3 corresponding to bits "1" in the bit pattern (i.e., the color dots indicated by hatching in FIG. 5) are activated to display the character.

The above described conventional liquid crystal color display apparatus is disadvantageous in that, since the number of pixels per each character is small, slant segments of a displayed character are significantly uneven (see the slant segments of the character "A" at both of its shoulder portions in FIG. 5). It has thus been practically impossible to display a character of a good quality.

SUMMARY OF THE INVENTION

It is therefore an object of the present invention to provide a display apparatus which is capable of displaying patterns, such as characters, of a good quality with a limited number of color pixels.

According to the present invention, there is provided a color display apparatus comprising a color display panel on which a plurality of color dots of the three primary colors are formed in a predetermined order, a memory for storing bit information corresponding to dot-matrix patterns representative of characters, and a display control section for activating the color dots on the color display panel in accordance with the bit information read from the memory to thereby display characters. The invention is characterized in that the memory is provided with at least three storage areas corresponding respectively to the color-dot groups of the three primary colors, in that each storage area stores bit information corresponding to dot-matrix patterns representative respectively of all kinds of characters to be displayed, the display control section activating the color dots of the three primary colors on the color display panel based respectively on three bit-information groups which are read respectively from said three storage areas and correspond to a character to be displayed, whereby the last-mentioned character is displayed on the color display panel.

With the above structure, in the case where the color dots of the three primary colors are arranged in each horizontal line in a certain order in a cyclic fashion, one color pixel can be formed not only by the combination of color dots of the three primary colors arranged in a specific order as in the conventional apparatus, but also by those combinations of color dots of the three primary colors which are arranged in other orders (the combinations of color dots in the order of red, green and blue and the combination of color dots in the order of green, blue and red when the color dots are arranged in the order of red, green and blue in a cyclic fashion). Therefore, horizontal positions of the respective color pixels which form a character to be displayed can be selected three times more finely than in the conventional apparatus. As a result, character patterns of a better quality can be displayed with the same number of color dots.

BRIEF DESCRIPTION OF THE DRAWING

An embodiment of the invention will now be described with reference to the accompanying drawings, in which.

DESCRIPTION OF THE PREFERRED EMBODIMENTS

Figure 1:
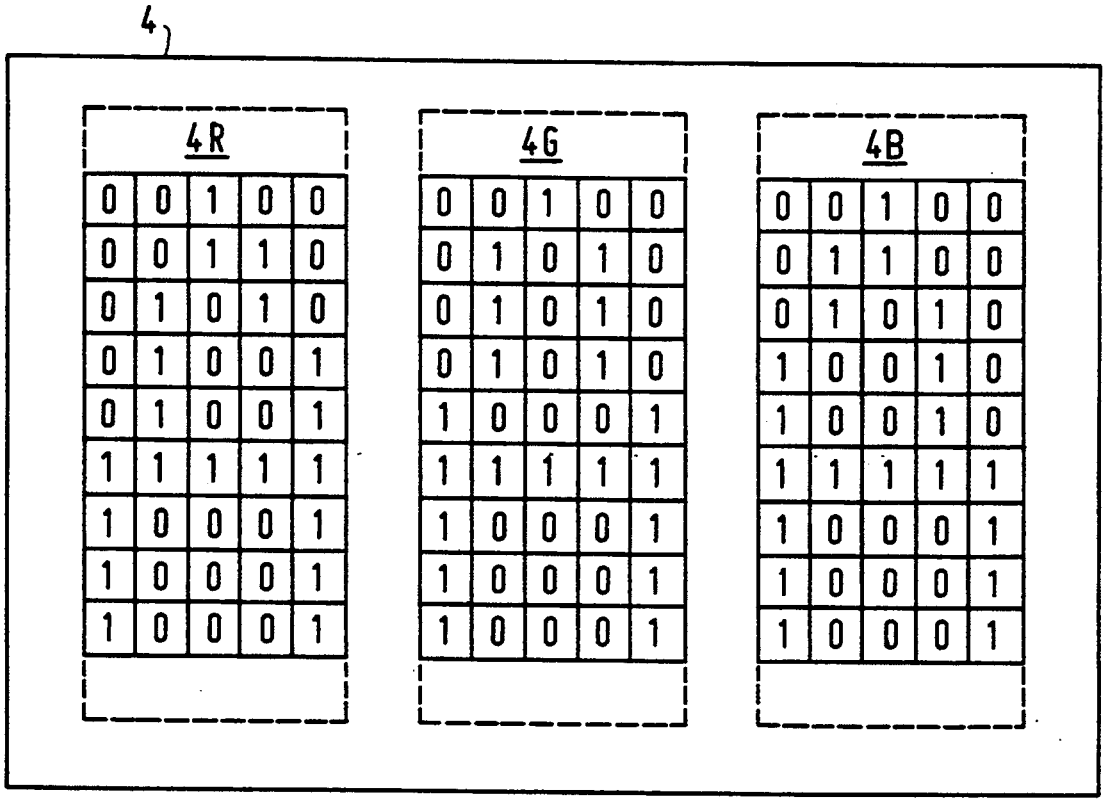
FIG. 1 is a diagrammatic illustration showing the structure of a memory in one embodiment of a color display apparatus according to the invention, wherein bit information representative of the character "A" stored in the memory is shown.
Figure 2:
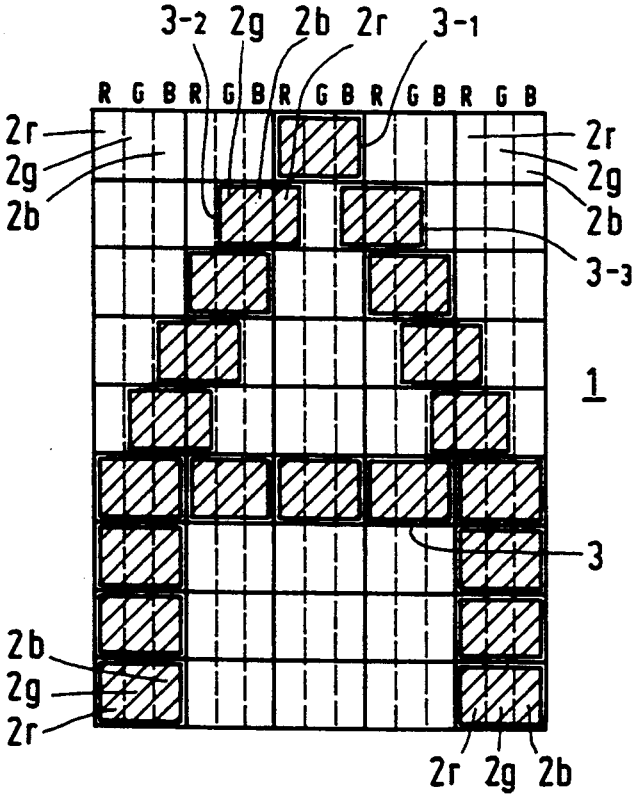
FIG. 2 is an enlarged plan view of a part of a liquid crystal color display panel in the embodiment of the invention wherein the character "A" is displayed.
Figure 5:
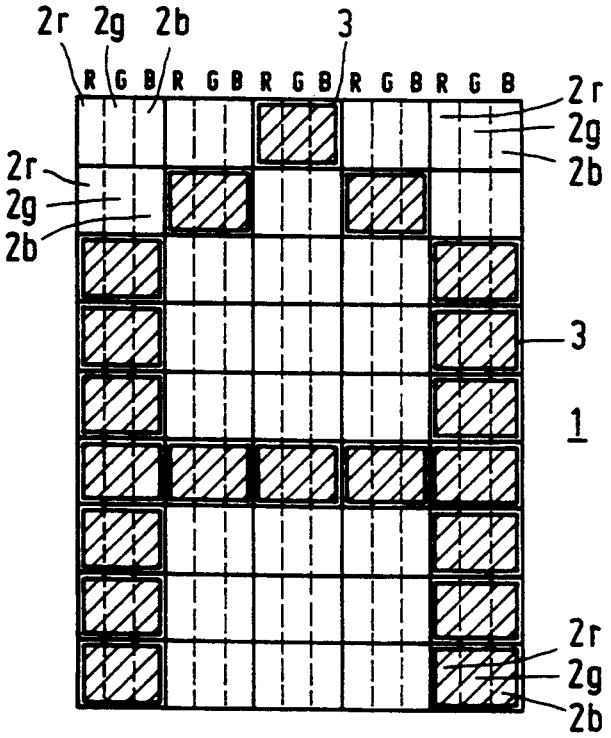
FIG.5 PRIOR ART
FIG. 5 is an enlarged plan view of a part of a liquid crystal color display panel in a conventional color display apparatus wherein the character "A" is displayed.
Figure 6:
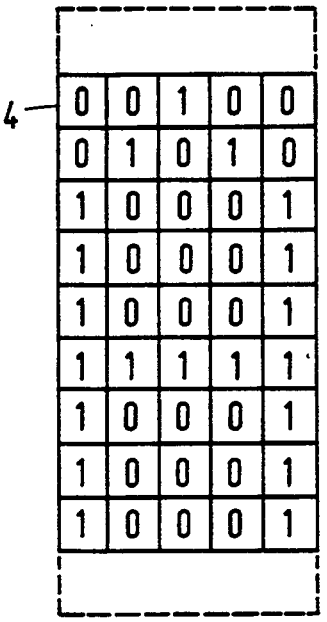
FIG.6 PRIOR ART
FIG. 6 is a diagrammatic illustration showing the structure of a memory in the conventional color display apparatus, wherein bit information representative of the character "A" stored in the memory is shown.

A color display apparatus according to an embodiment of the invention is shown in FIG. 2 and employs a liquid crystal color display panel 1 of the same structure as that shown in FIG. 5. A memory 4 of this display apparatus comprises, as shown in FIG. 1, a memory plane (or a storage area) 4R corresponding to the red (R) color dots *2r*, *2r*, *2r*, . . . of the display panel 1, a memory plane 4G corresponding to the green (G) color dots *2g*, *2g*, *2g*, . . . and a memory plane 4B corresponding to the blue (B) color dots *2b*, *2b*, *2b*, . . . In this case, one 5×9 bit-pattern is stored in each of the planes 4R, 4G and 4B for each character (in FIG. 1, only the three bit-patterns for the character "A" are shown). This enables the 5×9 dot-matrix for red, the 5×9 dot-matrix for green and the 5×9 dot-matrix for blue in the display area of 5×9 color pixels for one character to be driven independently of one another with respect to each character. The bit-patterns in the respective planes are determined, for example, in the following manner. In this embodiment, a color pixel 3 on the display panel 1 is formed not only by the combination of three color dots arranged in the order of red, green and blue from left to right, but also by the combination of color dots arranged in the order of green, blue and red from left to right and the combination of color dots arranged in the order of blue, red and green from left to right. For example, the color pixel $3_1$, located at the top of the character "A" in FIG. 2 is driven by the third bits "1" from the left in the top lines of the respective bit patterns in the three planes 4R, 4G and 4B in FIG. 1. The pixel $3_2$ adjoining the pixel $3_1$ at its lower left corner is driven by the third bit "1" from the left in the second line from the top of the bit pattern in the plane 4R, by the second bit "1" from the left in the second line from the top of the bit pattern in the plane 4G and by the second bit "1" from the left in the second line from the top of the bit pattern in the plane 4B. In a similar manner, the pixel $3_3$ adjoining the pixel $3_1$ at its lower right corner is driven by the fourth bit "1" from the left in the second line from the top of the bit pattern in the plane 4R, by the fourth bit "1" from the left in the second line from the top of the bit pattern in the plane 4G and by the third bit "1" from the left in the second line from the top of the bit pattern in the plane 4B. Thus, the color pixel $3_1$ is formed by the color dots arranged in the order of red, green and blue, the color pixel $3_2$ by the color dots arranged in the order of green, blue and red, and the color pixel $3_3$ by the color dots arranged in the order of blue, red and green.

In this manner, the shift amount in the horizontal direction between two adjacent color pixels in the slant segments of the character "A" can be reduced to one color dot. In comparison to this, the shift in the horizontal direction between two adjacent color pixels in the slant segments has amounted to three color dots in the conventional apparatus shown in FIG. 5. Thus, with this embodiment each slant segment of a character can be displayed in a smoothed or even shape, whereby the quality of the displayed character is enhanced. In other words, according to this embodiment it is possible to obtain a display which is effectively the same as that which is obtained when a character is displayed in a dot-matrix of 13×9.

Figure 3:
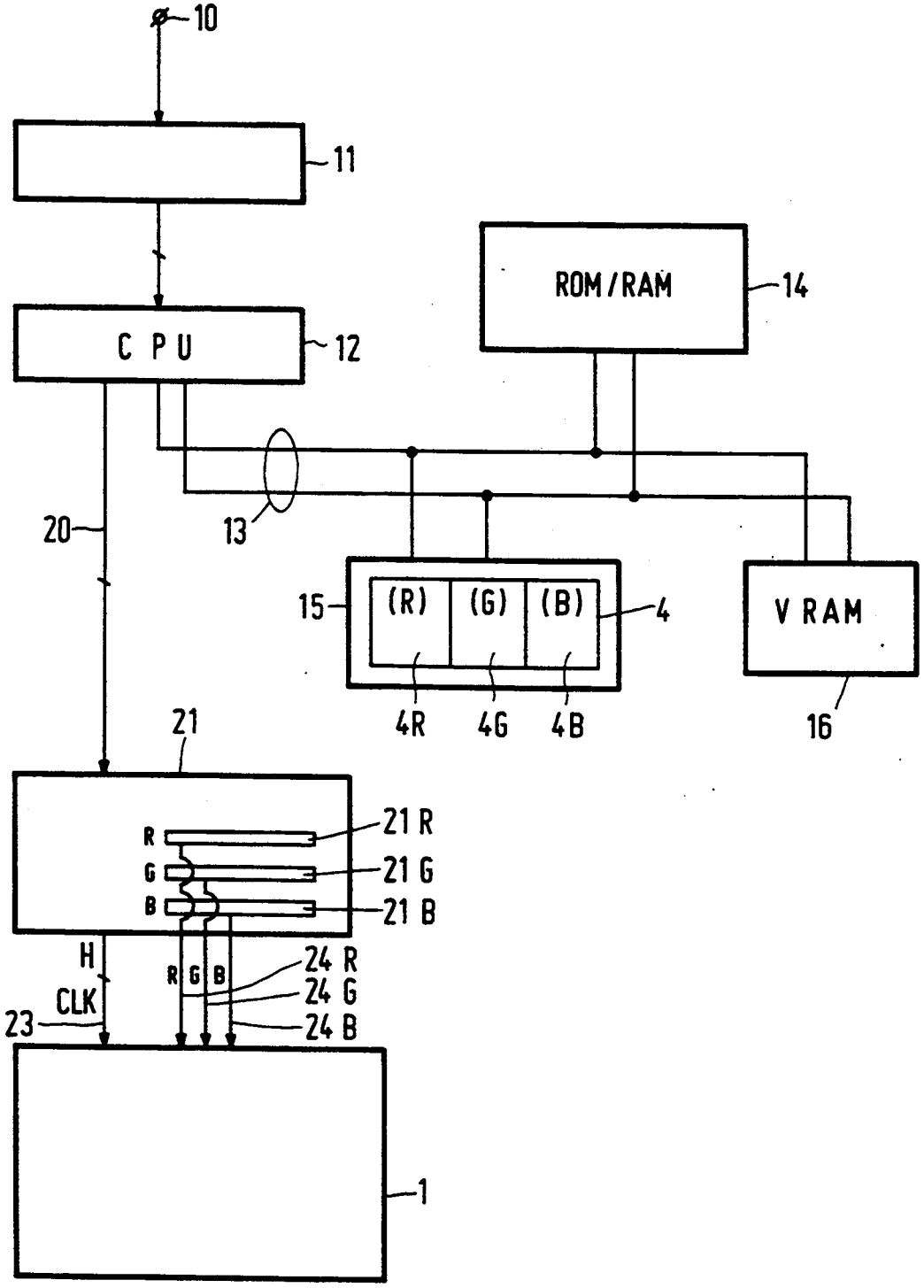
FIG. 3 is a block diagram of the embodiment of the invention which is applied to a teletext apparatus.

FIG. 3 is a block diagram of the above embodiment having the three storage planes 4R, 4G and 4B in the memory 4 when applied to a teletext apparatus.

In FIG. 3, the color display panel 1 is an active liquid-crystal color display panel with TFTs whose color dots are arranged as shown in FIG. 5 or 2. This display panel 1 has 720×720 color dots in total, for example.

This apparatus has an input terminal 10 for receiving a video signal which includes character information and is fed from a television radio-wave receiving section (not shown). The video signal is supplied to a character information separation circuit 11. The character information separated by the circuit 11 is supplied to a central processing unit (CPU) 12 which is constituted, for example, by a microprocessor. The CPU 12 is connected via a bus 13 to a ROM/RAM 14 for storing control programs for this apparatus, data and the like. The CPU 12 operates in accordance with the contents of the ROM/RAM 14. The CPU 12 discriminates characters to be displayed from the character information fed from the character information separation circuit 11 and supplies codes of the discriminated characters to a character generator 15 through the bus 13. The character generator 15 comprises the memory 4, whose structure is shown in FIG. 1, and reads and outputs three bit-patterns respectively from the three planes 4R, 4G and 4B in response to a supplied character code. These three bit-patterns are then stored in a video RAM (VRAM) 16.

When bit-patterns of characters for one entire screen has been stored in the VRAM 16, the CPU 12 reads respective bit data of the bit-patterns in a parallel fashion in accordance with the order of scanning of the display panel and supplies the read bit data via a bus 20 to a display controller 21. The display controller 21 comprises three color registers 21R, 21G and 21B, which correspond to the planes 4R, 4G and 4B, respectively, and the bit data corresponding to the planes 4R, 4G and 4B are loaded into the color registers 21R, 21G and 21B, respectively. The display controller 21 is connected to the color display panel 1 via a control signal bus 23 for supplying control signals such as a horizontal synchronization signal H and a clock signal CLK, and also via three color signal lines 24R, 24G and 24B for supplying respective shift outputs of the color registers 21R, 21G and 21B.

Figure 4:
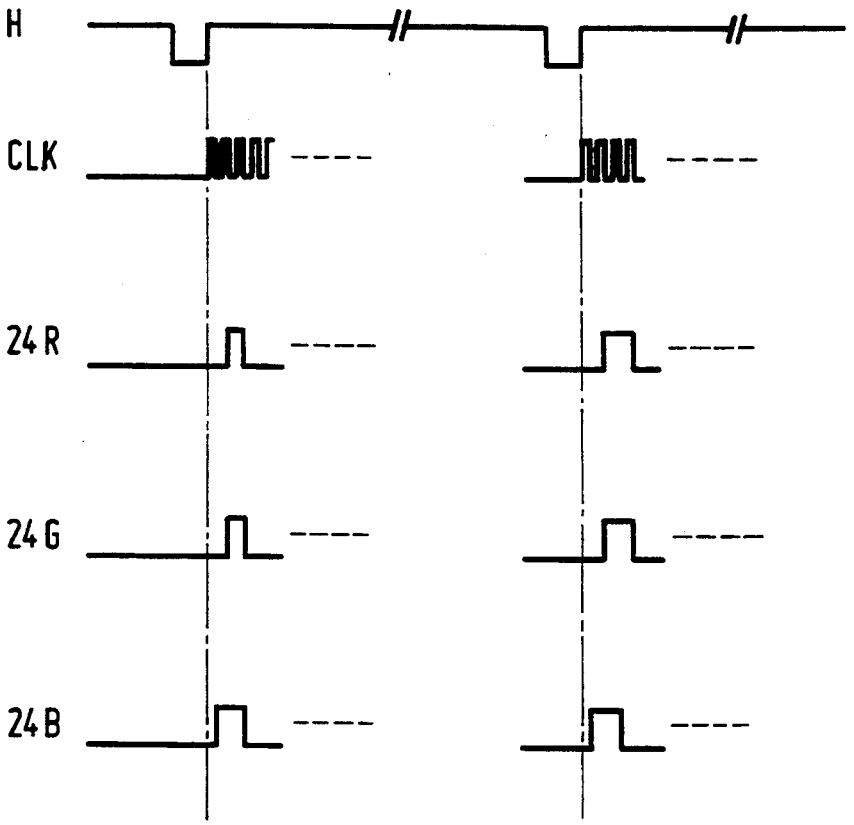
FIG. 4 is a time chart of the various signals in the embodiment of FIG. 3.

FIG. 4 is a time chart showing the relation between various output signals of the display controller 21. As shown, the display controller 21 sequentially outputs bit data from the respective color registers 21R, 21G and 21B onto a horizontal line, determined with reference to the horizontal synchronization signal H, with clock signal CLK. Thus, color dots on the display panel 1 are driven in accordance with these outputs, wherein a combination of three adjacent color dots of the three primary colors are driven as a pixel, so that the pixel is recognized as a pixel having a color almost equal to white.

According to this color display apparatus, it is thus possible to display characters on the display panel with a high quality as shown in FIG. 2.

In the conventional apparatus, there was a possibility that a color pixel in a slant segment of a displayed character had no neighboring color pixel which was immediately adjacent to the first-mentioned color pixel in the vertical direction. Such a color pixel is liable to be recognized by the human eye so that the three primary colors thereof are independent and not properly mixed together. According to this invention, however, it is possible to arrange every color pixel in a slant segment of a character so as to have a neighbouring color pixel which is directly adjacent to the first-mentioned color pixel. This will solve the above problem.

Although the above embodiment is described referring to the case where a color pixel is constituted by three color dots of the three primary colors arranged in the horizontal direction, the present invention should not be restricted only to this case, and it will be apparent that this invention can also be applicable to such cases where color dots are arranged in a delta fashion or in other configurations. Furthermore, although the color display panel in the above embodiment is of the liquid crystal type, a color display panel of other types such as the EC type can also be used in this invention. The invention can also be used in a conventional CRT in which the information from the different memory parts is used to energize phosphor dots of neighbouring pixels.

We claim:

1. A color display apparatus comprising: a color display panel containing a plurality of color dots of equal size and comprising three primary colors formed in a predetermined order in which the color dots of each primary color are respectively aligned in vertical columns on the display panel, a memory for storing bit information corresponding to dot-matrix patterns representative of characters to be displayed, and a display control section for activating the color dots on the color display panel in accordance with the bit information read from the memory to thereby display characters, characterized in that the memory is provided with at least three storage areas corresponding respectively to color-dot groups of the three primary colors, in that each storage area stores bit information corresponding to dot-matrix patterns representative respectively of a plurality of characters to be displayed, wherein to display a character, the display control section activates the color dots of the three primary colors on the color display panel based respectively on data read respectively from said three storage areas and in a manner such that the three primary color dots for a slant segment of the character are activated in a sequence different from the activation sequence of the three primary color dots of a non-slant segment of the character displayed on the color display panel.

2. A color display apparatus according to claim 1, characterized in that the display panel comprises a liquid crystal device.

3. A color display apparatus comprising:

a color display device containing a plurality of color dots comprising three primary colors arranged in rows and columns with the color dots of each primary color respectively aligned in columns, an input for supplying to the display apparatus a video signal with character data, a memory device for storing binary bit information corresponding to dot-matrix patterns representing characters to be displayed on the color display device, said memory device comprising at least three storage areas corresponding respectively to color-dot groups of the three primary colors and with each storage area storing bit information corresponding to dot-matrix patterns of the characters to be displayed in a manner whereby, read-out of said bit information defines one or more display pixels in one or more color dot rows of the display device, wherein each display pixel in a row includes three adjacent color dots activated in a color dot sequence that is not fixed and which is determined by a character to be displayed, and a display control device coupled to said input and to said memory device for activating the color dots of the three primary colors of the color display device in accordance with three bit information groups read out from the respective three storage areas of the memory device.

4. A color display apparatus as claimed in claim 3, wherein the three primary colors are red, green and blue and said characters bit information are stored in said three storage areas of the memory device in dot-matrix patterns such that one or more certain selected display pixels can comprise three color bits in any one of the three following sequences, red green and blue; green, blue and red; and blue, red and green.

5. A color display apparatus as claimed in claim 3, wherein the memory device comprises three planes of storage one storage plane for each primary color, and with bit patterns for certain selected display pixels shifted with respect to bit patterns for other display pixels.

6. A color display apparatus as claimed in claim 3, further comprising;

a video RAM coupled to said memory device and to said display control device for the temporary storage of three-bit color dot patterns read out from the memory device under control of the display control device, and a display controller coupled to the color display device and to the video RAM and controlled by said display control device to activate the display pixels of the color display device in accordance with the stored character information.

7. A color display apparatus as claimed in claim 3, wherein the color display device comprises a liquid crystal display panel and said color dots sequence of said display pixel in any given row of the display panel is dependent on the character to be displayed.

8. A color display apparatus as claimed in claim 4 wherein the display control device activates the three primary color dots in a slant segment of a displayed character, as determined by the dot-matrix patterns of character bit information stored in said three storage areas of the memory device, in a sequence other than the sequence for a non-slant segment whereby a character with a relatively smooth slant segment is displayed on the color display device.

9. A color display apparatus as claimed in claim 3 wherein all of the color dots in the color display device are of equal size.

10. A color display apparatus as claimed in claim 5 wherein display pixels on slant segments of a displayed character are of equal size to display pixels of non-slant segments of the displayed character.

11. A color display apparatus as claimed in claim 3 wherein said display control device activates at least one color dot of a slant segment of a displayed character which is in vertical alignment with a corresponding activated color dot of a non-slant segment of the displayed character.

12. A color display apparatus as claimed in claim 11 wherein the color display device comprises a liquid display panel.

13. A color display apparatus as claimed in claim 3 wherein certain selected display pixels comprise pixels forming slant segments of a displayed character.

14. A color display apparatus as claimed in claim 13 wherein at least one of said certain selected display pixels in one row is shifted less than three color dots along the row with respect to the color dots of an adjacent certain selected pixel in an adjacent row of the displayed character.

15. A color display apparatus as claimed in claim 3 wherein certain selected display pixels comprise pixels forming slant segments of a displayed character in which first and second certain selected display pixels of a slant segment in successive rows of the color display device are offset in the row direction such that they are partly in alignment in the column direction.

16. A color display apparatus comprising:

a color display device containing a plurality of color dots made up of three primary colors arranged in rows and columns with the color dots of each primary color aligned in columns, an input for supplying to the display apparatus a video signal with character data, a memory device for storing binary bit information corresponding to dot-matrix patterns representing characters to be displayed on the color display device, said memory device comprising at least three storage areas corresponding respectively to color dot groups of the three primary colors and with each storage area storing bit information corresponding to dot-matrix patterns of the characters to be displayed in a manner whereby, upon readout of said bit information, selected display pixels include three color dots activated in a sequence determined by a character to be displayed, and a display control device coupled to said input and to said memory device for activating the color dots of the three primary colors of the color display device in accordance with the patterns of character bit information stored in said three storage areas of the memory device so that the three primary color dots in a slant segment of a displayed character are activated in a sequence different from other segments of the displayed character whereby said displayed character with a relatively smooth slant segment is displayed on the color display device.

17. A color display apparatus as claimed in claim 16 wherein each selected display pixel includes three adjacent activated color dots.

18. A color display apparatus as claimed in claim 16 wherein first and second selected display pixels in successive rows of the color display device making up said slant segment are offset in the row direction so that they are in partial alignment.

19. A color display apparatus as claimed in claim 16 wherein the color display device comprises a liquid crystal display panel.

20. A color display apparatus comprising:

a color display device including a plurality of color dots of three primary colors which are arranged in rows and columns with the color dots of each primary color vertically aligned in columns, a signal input for character data, a memory device for storing binary bit information corresponding to dot-matrix patterns representing characters to be displayed on the color display device, said memory device comprising at least three storage areas corresponding respectively to color-dot groups of the three primary colors and with each storage area storing bit information corresponding to dot-matrix patterns of the characters to be displayed in a manner such that display pixels in a row comprise three primary color dots which are activated in different sequences determined by said characters to be displayed such that a color dots sequence of a display pixel within a row is not fixed but is determined by said characters to be displayed, and a display control device coupled to said signal input and to said memory device for activating the color dots of the three primary colors of the color display device in accordance with the dot-matrix patterns of character bit information stored in said three storage areas of the memory device.

* * * * *